US007197908B2

(12) United States Patent
Oki et al.

(10) Patent No.: US 7,197,908 B2
(45) Date of Patent: Apr. 3, 2007

(54) METHOD OF MANUFACTURING A MEMBER HAVING TOOTHED PORTION

(75) Inventors: Hideki Oki, Fukuroi (JP); Shouji Yatsuyanagi, Fukuroi (JP); Tomoyuki Miyazaki, Fukuroi (JP); Kiyokazu Ichikawa, Fukuroi (JP)

(73) Assignee: NSK Warner K.K., Tokyo (JP)

( * ) Notice: Subject to any disclaimer, the term of this patent is extended or adjusted under 35 U.S.C. 154(b) by 0 days.

(21) Appl. No.: 11/187,915

(22) Filed: Jul. 25, 2005

(65) Prior Publication Data

US 2006/0016075 A1 Jan. 26, 2006

(30) Foreign Application Priority Data

Jul. 26, 2004 (JP) ..... 2004-217243

(51) Int. Cl.
*B21J 13/00* (2006.01)

(52) U.S. Cl. ..... 72/354.6; 72/348

(58) Field of Classification Search ..... 72/354.6, 72/354.8, 355.2, 355.4, 348
See application file for complete search history.

(56) References Cited

FOREIGN PATENT DOCUMENTS

JP 1-317653 * 12/1989 ..... 72/354.8
JP 6-193647 7/1994

* cited by examiner

*Primary Examiner*—Lowell A. Larson
*Assistant Examiner*—Debra Wolfe
(74) *Attorney, Agent, or Firm*—Miles & Stockbridge PC

(57) ABSTRACT

A method of manufacturing a member having a toothed portion, comprises a first step of cutting a work piece into predetermined dimensions and then deburring the same, and a second step, in succession with the first step, of pressing an axially end face of a portion to be toothed with a predetermined load, and simultaneously drawing the work piece so as to form the toothed portion.

3 Claims, 3 Drawing Sheets

METHOD OF MANUFACTURING A MEMBER HAVING TOOTHED PORTION

BACKGROUND OF THE INVENTION

1. Field of the Invention

The present invention relates to a method of manufacturing a member having a toothed portion, and in particular to a method of manufacturing a clutch housing or a clutch hub for an automatic transmission used in an automobile or the like.

2. Description of the Related Art

A clutch housing incorporates therein a clutch unit composed of a plurality of friction plates and separator plates. The clutch housing is formed at its inner periphery with toothed portions which serve as splines on which the friction plates and the separator plates are fitted so as to be axially displaceable.

Further, a clutch hub is formed on its outer peripheral surface with tooth-formed portions which serve as splines on which the friction plates and the separators are fitted so as to be axially displaceable.

A plurality of toothed portions which are extended in the axial direction of the clutch housing or the clutch hub, and which are arranged circumferentially thereof, have to be formed with a required degree of accuracy so as to allow the friction plates and the separator plates to be smoothly displaced in the axial direction. Thus, in order to finish up the toothed portions so as to have desired axial dimensions, the toothed portions are subjected to cutting and shear-trimming in order to have appropriate dimensions and are thereafter deburred.

Conventionally, the toothed portions have been subjected to cutting and shear-trimming, after axial formation of teeth, so as to have appropriate dimensions, and thereafter subjected to deburring.

However, since the toothed portion has a formed surface having a relatively complicated tooth shape, a manufacture method as disclosed in, for example, Japanese Patent Laid-Open No. H06-193647, has raised several problems such as follows:

At first, since the cutting is intermittent cutting while the shear-trimming is of an index type, and therefore, the following problems are caused:

(1) a long cycle time;

(2) requirement of an exclusive jig;

(3) requirement of labor for stabilizing a deburring quality due to increased work load during deburring.

The above-mentioned problems cause an increase in manufacturing costs, directly or indirectly.

Further, conventionally, there have been carried out intermittent cutting and index type shear-trimming after formation of teeth, and then deburring in order to finish up the toothed portion so as to have teeth with appropriate axial dimensions. However, the above-mentioned process steps are likely to cause a bottle neck problem which results in hindrance to enhancement of a productivity and stabilization of a quality. In particular, in the method disclosed in Japanese Patent Laid-Open No. H06-193647, teeth have to be formed by a cam mechanism after end-surface pressing, and accordingly, two process steps are required.

SUMMARY OF THE INVENTION

Accordingly, an object of the present invention is to provide a manufacture method including steps of cutting and deburring a work piece so as to have appropriate axial dimensions before formation of teeth, and thereafter, an end surface is pressed while teeth are formed by drawing. Thus, it is possible to propose a manufacture method which can eliminate a necessity of a necking step, and aim at reducing the costs, enhancing the productivity and stabilizing the quality.

To the end, according to the present invention, there is provided a method of manufacturing a member having a toothed portion, characterized by:

a first step of cutting a work piece so as to have predetermined dimensions, and then deburring the same; and a second step, in succession with the first step, of pressing an axially end surface of a part of the work piece to be toothed with a predetermined load, and simultaneously drawing the work piece so as to form teeth.

With this configuration of the present invention, it is possible to eliminate the necessity of a conventional necking step so as to exhibit a simpler process design and process steps, cost reduction (a shortened cycle time, elimination of the necessity of an exclusive jig, possible use of a general-purpose facility, elimination of the necessity of deburring with the use of chamfering during cutting, or labor-saving therefor.), and since the chamfered surface leaves a stabilized surface after formation of the teeth, it is possible to exhibit such technical effects and advantages as to aim at stabilizing a deburring quality (having a uniformly deburred surface, and maintaining a required degree of cleanliness), and further, at enhancing the productivity.

Further, since the end-surface pressing is simultaneously carried out, it is possible to prevent occurrence of breakage of a material due to a necking problem caused during tooth formation by drawing. Further, the degree of accuracy of teeth can be enhanced.

DESCRIPTION OF THE PREFERRED EMBODIMENTS

Figure 1:
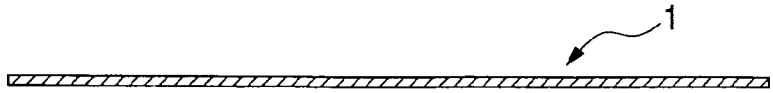
FIG. 1 is an axially sectional view illustrating a work piece used in an embodiment of the present invention.

Explanation will be hereinbelow made of an embodiment of the present invention with reference to the accompanying drawings. It should be noted that the embodiment which will be hereinbelow described is only of an exemplified form, and accordingly, the present invention should not be limited to this embodiment. Thus, several modifications and changes can be made to this embodiment without departing the technical scope of the present invention. Further, like reference numerals are used to denote like parts throughout the drawings.

FIGS. 1 to 7 are sectional views illustrating an embodiment of a manufacture method in which the present invention is applied to a clutch drum or a clutch housing, and which show plastic working or pressing with which a material blank or a work piece is formed into a finished product. At first, as shown in FIG. 1, a plate-like work piece (blank material) 1 which is a steel sheet having a substantially circular shape, is prepared, having predetermined dimensions with which a clutch housing to be manufactured can have a required shape and volume.

Figure 2:
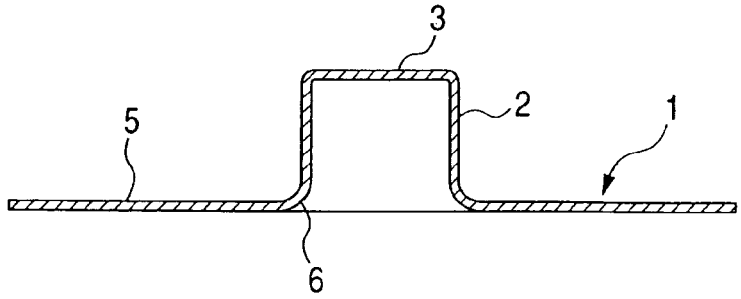
FIG. 2 is a view for explaining process steps of forming a hub portion.

Next, this work piece 1 is subjected to plastic working by a press so as to be formed into a shape shown in FIG. 2 in which the work piece 1 has a substantially flat disc portion 5, a substantially cylindrical hub portion 2, and a top portion 3 covering the hub portion 2. An annular curved part having a predetermined curvature is formed between the disc portion 5 and the hub portion 2.

Figure 3:
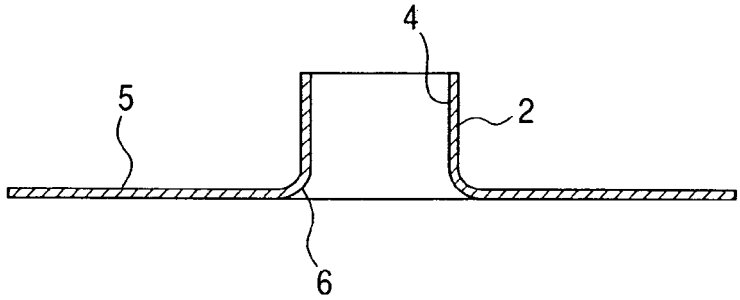
FIG. 3 is a view which shows a condition in which the top plate of the work piece shown in FIG. 2 is punched out.

Next, referring to FIG. 3, the top portion 3 is punched out by a press so as to form a through hole 4 in the hub portion 2. Thereafter, as shown in FIG. 4, the work piece 1 is subjected to machining.

Figure 4:
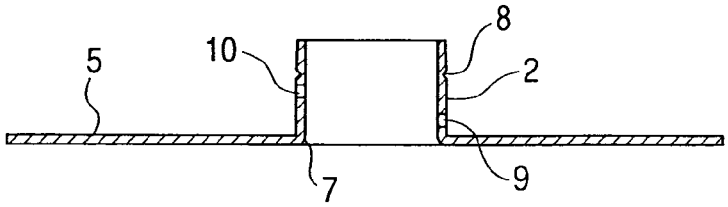
FIG. 4 is a view for explaining a process step of machining the hub.

Referring to FIG. 4, by lathing as the machining, a circular groove 8 is formed in the vicinity of the outer periphery of the hub portion 2. This circular groove 8 is adapted to be fitted therein with a stopper ring or an O-ring. The cylindrical part of the hub portion 2 is formed, by drilling or the like, with oil holes 9, 10 piercing therethrough. The oil holes 9, 10 are circumferentially formed by a plural number which is optional, but it is preferable to form the oil holes 9, 10 at circumferentially equal pitches. In this configuration, since nothing is present around the hub portion 2, the drilling for forming the oil holes can be easily made at accurate positions.

Figure 5:
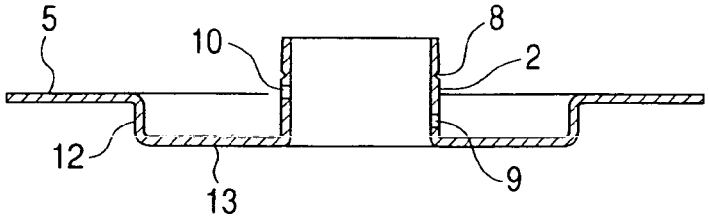
FIG. 5 is a view for explaining process steps of drawing the work piece.
Figure 6:
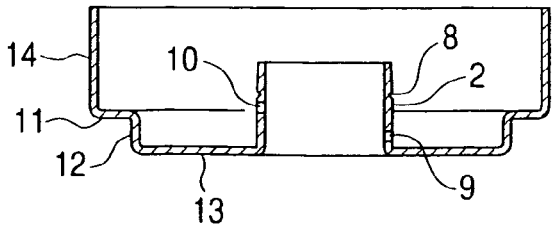
FIG. 6 is a view for explaining process steps of forming an outer drum portion by drawing the work piece.

FIGS. 5 and 6 show process steps for drawing the work piece 1 so as to form a housing, and then forming an outer drum portion. At first, referring to FIG. 5, by drawing the disc portion 5, an inner diameter disc portion 13 and an outer diameter disc portion 11 are formed. The inner diameter disc portion 13 and the outer diameter disc portion 11 are connected to each other by a first cylindrical part 12.

Next, referring to FIG. 6, by further drawing the work piece 1, the outer diameter disc portion 11 is deformed so as to obtain a substantially cylindrical outer drum portion 14. As clearly understood from FIGS. 5 and 6, the cylindrical part 12 has a height which is substantially one half of the height of the hub portion 2, and the outer drum portion 14 is axially extended so as to completely surround the hub portion 2.

Figure 7:
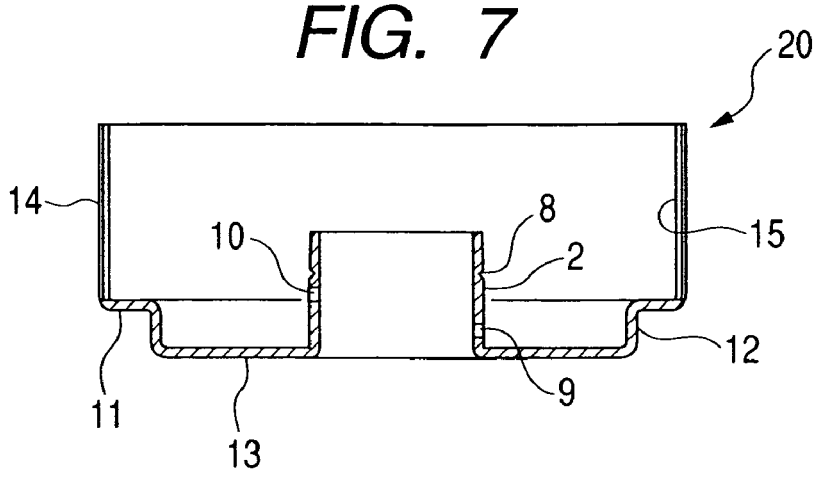
FIG. 7 is an axially sectional view illustrating a clutch housing formed as a substantially finished product after splining the outer drum portion.

Finally, referring to FIG. 7, the outer drum portion 14 is worked so as to form splines 15 at the inner periphery thereof. That is, teeth are formed at the inner periphery thereof so as to obtain a substantially completed clutch housing 20. Although the splines 15 are formed at the outer periphery in the configuration shown in FIG. 7, splines may be formed at the inner periphery of the outer drum portion 14.

After completion of the process steps shown in FIG. 7, finishing steps are carried out by lathing the product in its entirety. It is noted here that the space defined being surrounded by the outer drum portion 14 accommodates therein a friction engagement assembly (which is not shown) serving as a clutch, and a piston (which is not shown) pressing the friction engagement assembly is located so as to be displaceable under hydraulic pressure in a hydraulic chamber (which is not shown) defined between the piston and the disc portion 13.

Figure 8:
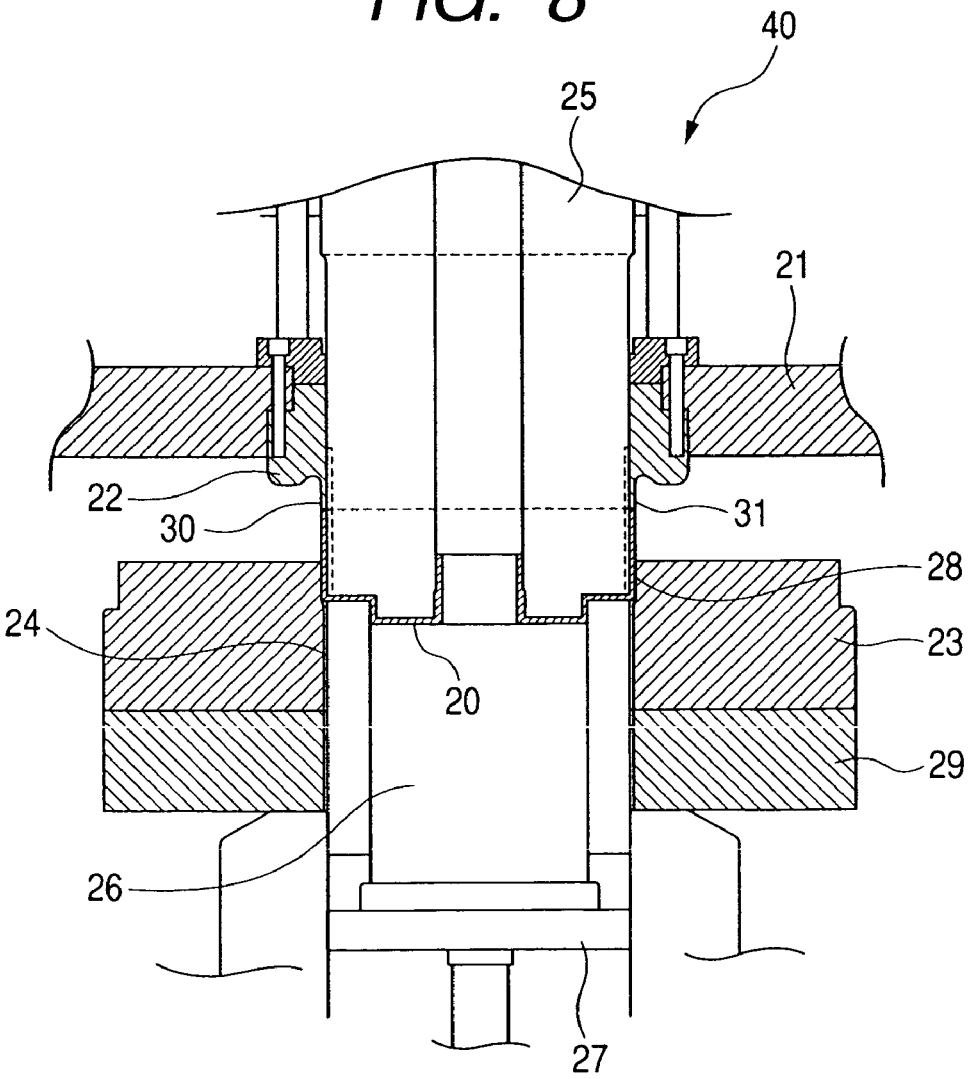
FIG. 8 is an axially sectional view illustrating a tooth forming device at a start of a working stroke.
Figure 9:
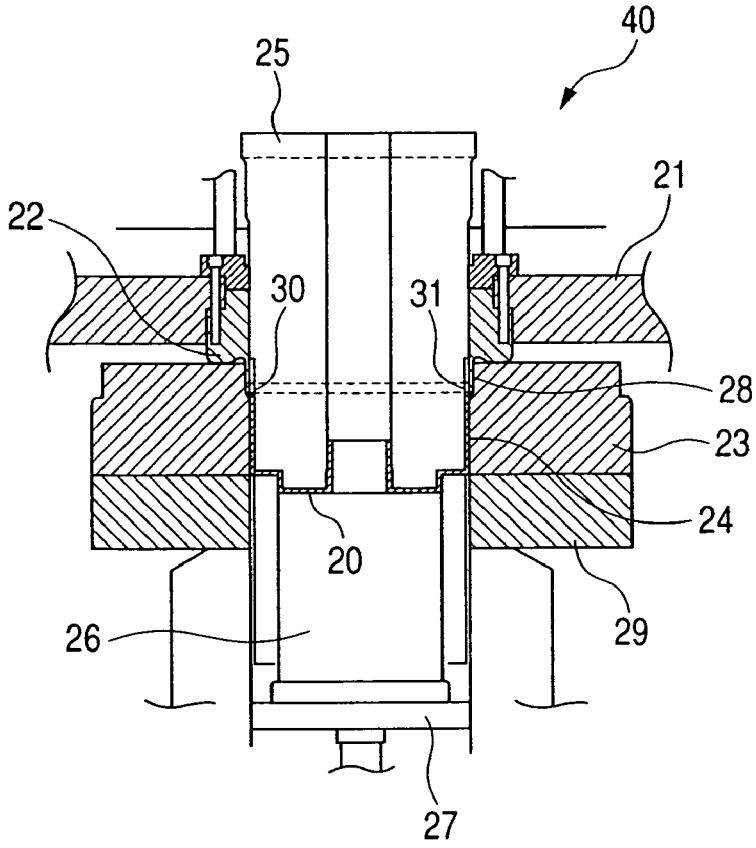
FIG. 9 is an axially sectional view illustrating the tooth forming device at an intermediate position during the working stroke.
Figure 10:
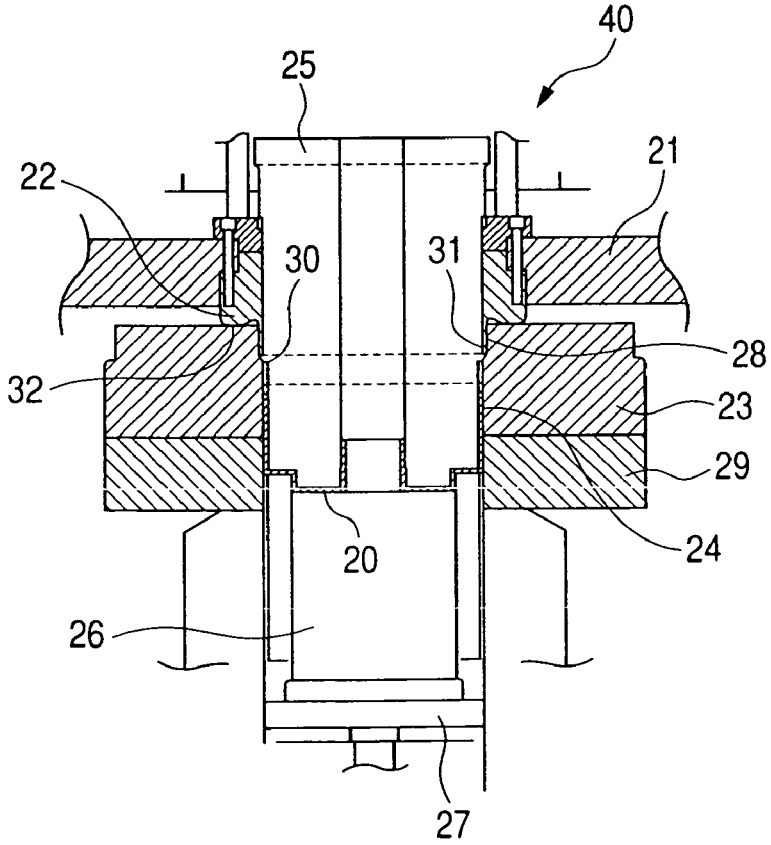
FIG. 10 is an axially sectional view illustrating the tooth forming device at a complete position of the working stroke.

FIGS. 8 to 10 are views for explaining a method for forming teeth at the inner periphery of the clutch housing 20 as shown in FIG. 7, among which FIG. 8 is an axially sectional view illustrating a tooth forming device 40 at a start of working stroke, FIG. 9 is an axially sectional view illustrating the tooth forming device 40 at a position intermediate of the working stroke, and FIG. 10 is an axially sectional view illustrating the tooth forming device 40 at a complete position of the working stroke.

At the drawing step shown in FIG. 6, the clutch housing 20 is subjected to cutting and deburring so as to have appropriate dimensions. Referring to FIG. 8, the tooth forming device 40 is composed of a die 23 formed at its inner periphery with teeth, a work piece support part 26 for carrying thereon the clutch housing 20 as a work piece, and a punch 25 for pressing the clutch housing 20 against the die 23.

The tooth forming device 40 further comprises a tooth forming guide 22 in which the punch 25 is fitted and which is supported by a support part 21. The clutch housing 20 is displaced in a direction in which the die 23 is pressed, by the punch 25 and the tooth forming guide 22 under respective hydraulic pressures which are fed from hydraulic circuits which are not shown and which are independent from each other.

Next, explanation will be made of the die 23. The die 23 has an inner periphery which is composed of a tooth part 24 in which teeth are formed being axially extended, and a cylindrical wall part 28 adjacent to the tooth part 24 and defining an opening. The cylindrical wall part 28 has a large diameter in comparison with that of the tooth part 24, That is, the die 23 has different inner diameters. The die 23 is supported by a die support part 29 as shown.

A smooth tapered interface is formed between the cylindrical wall part 28 and the tooth part 24. The clutch housing 20 has a diameter which is set to be slightly smaller than the inner diameter of the cylindrical wall part 28, but to be larger than the inner diameter of the tooth part 24. At a start of working stroke as shown in FIG. 8, the outer drum portion 14 of the clutch housing 20 is inserted only in the cylindrical wall part 28.

It is noted here that during process steps for forming teeth as shown in FIGS. 8 and 9, the tooth forming guide is displaceable, relative to the punch 25, the axially lower end part of the tooth forming guide 22 abuts against the axially end face 30 of the clutch housing 20 which is an opening end. That is, the body of the clutch housing 20 is pressed by the punch 25, and simultaneously, the axially end face 30 thereof is pressed by the lower end part 31 of the tooth forming guide 22 by a predetermined force.

After pressing further from the condition shown in FIG. 8, at an intermediate position shown in FIG. 9, a substantial part of the outer drum portion 14 of the clutch housing 20 is drawn by the tooth part 24 of the die 23 so as to form teeth. However, a part in the vicinity of the axially end face 30 is still positioned within the cylindrical wall part 28, and is pressed by the lower end part 31 of the tooth forming guide 22.

Finally, explanation will be made of the complete position of the working stroke with reference to FIG. 10. After the punch 25 is further displaced from the condition shown in FIG. 9 so as to press the clutch housing 20, the outer drum portion 14 has passed in its entirety through the tooth part 24 of the die 23. That is, the teeth (that is, splines 15 shown in FIG. 7) are formed over the overall entire axial length of the outer drum portion 14. Thus, the clutch housing 20 shown in FIG. 7 has been completely formed. In this configuration, since the teeth are formed while the axially end face 30 is pressed, it is possible to ensure tooth depth dimensions.

At the final position shown in FIG. 10, the lower end part 3l of the tooth forming guide 22 does not abut against the axially end face 30 of the clutch housing 20, any more. This is because the tooth forming guide 22 stops immediately before the final stage due to interference between the tooth forming guide 22 and the die 23. The tooth forming guide 22 is formed in its lower part with a stopper part 32 which is adapted to abut against the upper surface of the die 23 so that the lower end part 31 is separated from the axially end face 30.

As stated above, since the end face is pressed at the same time when the teeth are formed. It is possible to prevent occurrence of breakage of a material which would be caused by a necking problem in the case of formation of teeth by drawing with different diameters. Further, since the clutch housing is subjected to compression due to the end face pressing, the blank material is pressed into the tooth part of the die, thereby it is possible to form satisfactory teeth.

As stated above, although explanation has been made of the method for forming the teeth at the outer periphery or the inner periphery of the clutch housing, it is also possible to apply the present invention for forming teeth in a clutch hub with some modification to the tooth forming device. Further, the method according to the present invention may be applied to components associated with a clutch, such as toothed pulley, having teeth on its outer or inner side, irrespective of the presence of a boss portion.

Although explanation has been made of the clutch housing 20 having the hub portion 2 located therein, it goes without saying that the method according to the present invention can be applied to such a configuration that a hub is extended outward, or hubs are extended both outward and inward. That is, the present invention can be used widely, inclusive of manufacturing any component having a toothed part.

Further, the clutch housing or the clutch hub manufactured by the method according to the present invention can be used in an automatic transmission. It is noted here that a multi-disc type friction engagement assembly may be used as any kind of a wet-type clutch.

This application claims priority from Japanese Patent Application No. 2004-217243 filed Jul. 26, 2004, which is hereby incorporated by reference herein.

What is claimed is:

1. A method of manufacturing a member having a toothed portion, comprising:

a first step of cutting a work piece in predetermined dimensions, and then deburring the work piece, and a second step, in succession with the first step, of pressing an axial end face of a portion to be toothed of the work piece with a predetermined load by a punch and a tooth forming guide fitted on the punch, and simultaneously drawing the work piece so as to form the toothed portion, the punch and the tooth forming guide being controlled, independently of each other, with hydraulic pressure.

2. A method as set forth in claim 1, wherein the member is a substantially cylindrical clutch housing, and the toothed portion is formed at an inner periphery or an outer periphery of the clutch housing.

3. A method as set forth in claim 1, wherein the member is a substantially cylindrical clutch hub, and the toothed portion is formed at an inner periphery or an outer periphery of the clutch hub.

* * * * *